United States Patent [19]

Bellofatto

[11] Patent Number: 4,944,253

[45] Date of Patent: Jul. 31, 1990

[54] SAFETY SYSTEM FOR HYDRONIC WATER HEATERS AND BOILERS

[76] Inventor: Richard C. Bellofatto, 4 Lewis Cir., Peabody, Mass. 01960

[21] Appl. No.: 419,471

[22] Filed: Oct. 10, 1989

[51] Int. Cl.[5] ..... F22B 35/00

[52] U.S. Cl. ..... 122/504; 122/507; 137/312; 126/374; 126/351

[58] Field of Search ..... 126/374, 351, 383, 385; 137/312; 122/504, 504.2, 507

[56] References Cited

U.S. PATENT DOCUMENTS

| | | | |
|---|---|---|---|
| 3,063,432 | 11/1962 | Bond et al. | 122/504 |
| 3,069,671 | 12/1962 | Taylor | 122/504 |
| 4,572,113 | 2/1986 | Baughman | 122/507 |
| 4,805,662 | 2/1989 | Moody | 122/507 |

*Primary Examiner*—Caroll B. Dority
*Attorney, Agent, or Firm*—Donald W. Meeker

[57] ABSTRACT

A water proof sheet slopes into a built-in shallow basin under a water device to collect any water leaking from the water tank in the device. Water sensitive elevated low voltage contacts in the basin are electrically connected to a relay. Conductors from the relay connect to shut-offs in the cold water supply, the hot water outflow and the power supply. Additional conductors connect from the relay to a valve on the outflow pipe to drain the tank and to a signal device. Alternatively, a water pump may be used instead of the valve on the outflow pipe to pump water to a distant drain, when there is no drain below the tank level into which to empty the tank.

15 Claims, 1 Drawing Sheet

SAFETY SYSTEM FOR HYDRONIC WATER HEATERS AND BOILERS

BACKGROUND OF THE INVENTION

1. Technical Field

The present invention relates to safety devices for hydronic water heaters and water boilers and in particular to a complete safety system for shutting down all power and water sources in the event of a leak to prevent water damage and other hazards.

2. Description of the Prior Art

Water tanks subject to heat and constant exposure to the water and sediment in the tank over time corrode and rust and produce leaks in the tank, particularly at the bottom of the tank where the sediment collects. Normally the way to determine when a tank is no longer good is simply to wait for it to leak and then replace it. Formerly water heaters and boilers were located in the basement of a building on cement floors usually provided with drains in the floor. Leaking water from the tank was of no concern. Today, however, water heaters and boilers may be located anywhere in a building including on the upper floors in many apartments. Water damage can be a very serious and expensive problem when a tank leaks. It is very important to detect a leak as soon as it begins and take action to prevent a quantity of water from leaking and causing damage.

Prior art safety devices for water heaters and boilers, upon detection of a leak, generally either generated a signal or shut off the water supply. They did not take into consideration all of the water in the system which could leak out through a backflow from the pipes into the boiler or heater. Nor did they consider emptying the tank to prevent standing water in the tank from leaking or shutting down all of the power or fuel sources. Should no one be available to hear or see the alarm and take action or should the tank water itself or the hot water in the heating system or water pipes leak back into the tank and out the hole, major water damage could occur.

Most prior art safety devices use mechanical means, such as tilting pans to collect leaking water connected to mechanical shutoffs for the water. These mechanical components are subject to error and problems with false alarms should anything else enter the pans or should the mechanical connection become stuck and the shutoff not function.

3. Disclosure of Invention

By providing a complete safety system which, upon detecting a leak in a water heating system, shuts down all sources of water leaks including the water supply, the outgoing heated water and the water in the tank, no possibility of leakage and water damage is present. Further shutting down the power source prevents continued heating to eliminate the built up pressure which heating produces and to prevent heating of an empty tank. A signal is also provided to let occupants known that there is a problem and that their water heater or boiler have been shut down.

An entirely electrical safety system with a backup battery ensures accurate dependable safety from water leakage without false alarms or mechanical failures.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
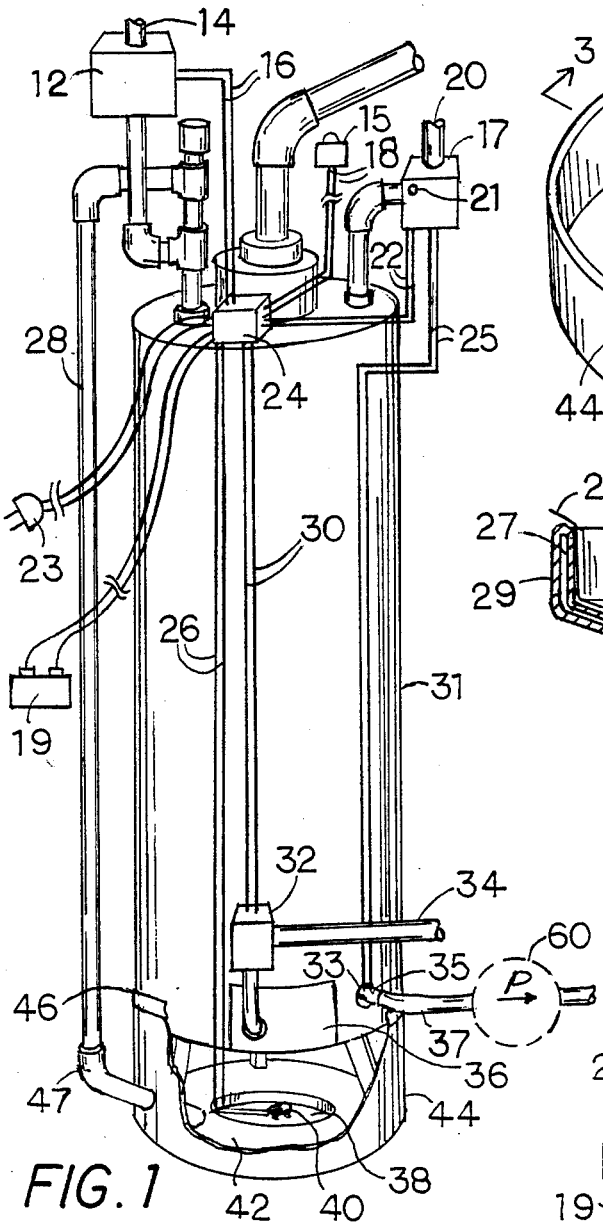
FIG. 1 is a perspective view in partial section of the safety system applied to a water heating unit.

In FIG. 1 a water heater or boiler 31 with heating element 36, power supply 34, cold water supply 20 and hot water distribution outlet 14 (and connected overflow drain 28) is further provided with the complete safety system for leak collection, detection and system shut-down.

Figure 2:
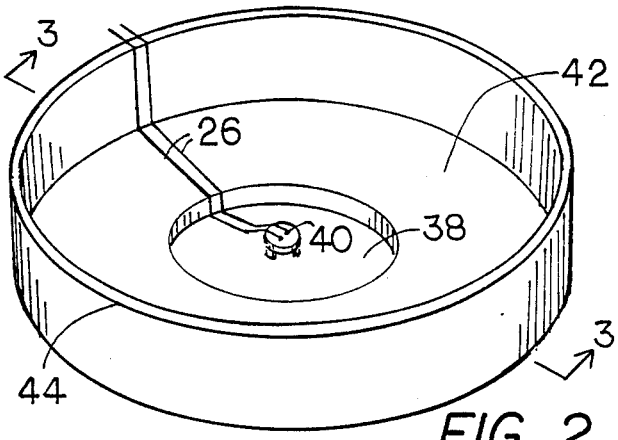
FIG. 2 is a perspective view of the water collecting and sensing components of the invention.
Figure 3:
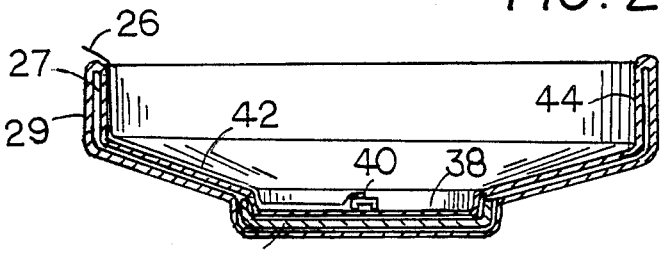
FIG. 3 is a cross-sectional view taken through 3—3 of FIG. 2 showing the water collecting and sensing components.

Below the heater with built-in water tank, a water collecting means comprises a water proof sheet of material 44 having a sloped area 42 leading to a shallow collection basin 38 for collecting any water which leaks from the water heating device. As seen in FIGS. 2 and 3, the water collecting means is preferably comprised of a double sheet of flexible water proof plastic or rubberized material having an inner 27 and an outer layer 29. Sandwiched in between the two layers, a rigid plastic or metal pan 25 serves to create the shallow collection basin 38. The outer edge of the water proof sheet may be attached to the bottom edge of the heater cover by tape 46 or other means.

Figure 5:
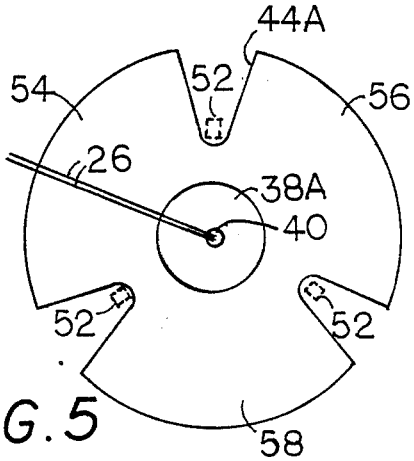
FIG. 5 is a plan view of an embodiment of the water collecting component for application to existing water heaters with slots in the waterproof sheet to fit around the legs of the water heater.

In FIG. 5 an alternate embodiment of the water collecting components, designed for application to an existing water heater, comprises a water proof sheet 44A having three extending flaps 54, 56 and 58 with slots inbetween the flaps so that the flaps may fit around the legs 52 of the existing water heater and the flaps attached by tape or other means to the lower sides of the water heater. This embodiment slides underneath a water heater already in use and the control elements are attached to the existing unit. In both embodiments of the water collecting means, the overflow drain 28 feeds into the water collecting means by a hose 47 extending from the bottom end of the overflow drain into the interior of the water collecting means.

Figure 4:
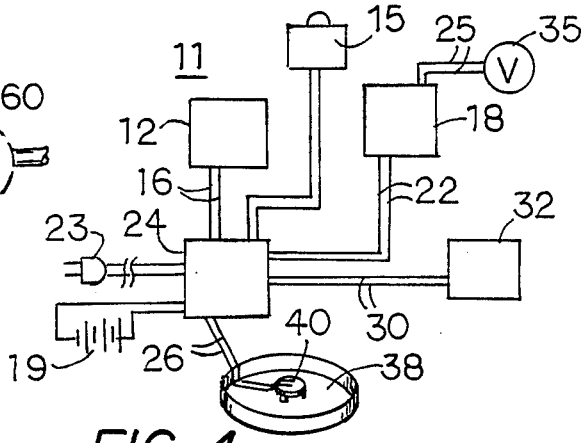
FIG. 4 is a schematic view of the total safety system.

Positioned on the bottom of the shallow basin, and slightly elevated above the bottom, a water sensing means comprises low power electrical contacts 40 sensitive to water for detecting any water which begins to accumulate within the basin. Elevating the sensing means (to a level below the height of the shallow collecting basin) would prevent a false alarm from minor condensation in the basin, so that the sensing means would only be activated with a substantial leak and the system would be deactivated before the water overflowed the collecting basin. As seen in FIGS. 1 and 4 a pair of electrical contacts 26 run from the water sensing contacts 40 to a 12 volt relay 24 which connects by a plug 23 with a 220 volt power source.

A normally open valve, the water supply control valve 18 controls the cold water supply through pipe 20. A pair of electrical conductors 22 from the relay 24, upon a signal from the water sensing contacts, closes the valve 18 to shut off the supply of cold water to prevent any more water from entering the leaking tank. To insure no leakage the tank of water may be drained by providing a pair of electrical contacts 25 between the water supply control valve 18 and a normally closed solenoid valve 35 attached to the water tank drain 33. When the water detector closes the water supply control valve 18 a signal from the water supply control valve then opens the tank drain solenoid valve 35 to drain all of the water out of the tank to empty the tank and prevent any further leakage from the tank. An air vent 21, a one-way air valve or check valve, controlled by a solenoid valve or other means, would automatically open when the tank drain solenoid opens so that the water would flow freely out of the tank through the tank drain. A hose 37 or pipe attached to the valve on the tank drain empties the water into an external drain or safety bladder to collect the water if a drain is not available below the level of the water tank. Another option would be to use a pump 60 to pump the water to a drain.

A means for preventing backflow of hot water from the hot water distribution outlet 14 comprises a normally open shut-off valve 12 between the hot water distribution system and the water tank. The normally open shut-off valve 12 is connected to the low voltage relay by electrical conductors 16 and is activated upon closing of the low power electrical contacts 40 by the presence of leaking water in the water collecting means. Alternately, a one-way valve between the water tank and the water distribution system would prevent backflow into the tank.

A power shut-off means 32 is attached to the power supply means 34 and electrically connected by conductors 30 to the relay 24. When the water sensing contacts 40 detect water in the collection basin, the relay activates the power shut-off means to terminate the power supply. When the water heating device comprises an electric water heater or an electric boiler having an electrical power supply, the power shut-off means comprises an electrical shut-off switch connected to the electrical power supply. When the water heating device comprises a gas water heater or gas boiler having a gas supply, the power shut-off means comprises a normally open shut-off valve connected to the gas supply. When the water heating device comprises an oil powered boiler having an oil supply, the power shut-off means comprises a normally open shut-off valve connected to the oil supply and an additional power shut-off means comprising an electrical shut-off switch connected to the electrical power supply for the oil powered boiler, wherein the additional power shut-off means is also electrically connected to the low voltage relay and is activated upon closing of the water sensing electrical contacts by the presence of water in the water collecting means.

In case of a power outage the safety system is further provided with an auxiliary power source in the form of a battery and transformer 19 which can run the safety system in place of the power through the plug 23.

When the safety system senses water and activates to prevent further leakage, the relay 24 through conductors 17 activates a signal device 15 which could be audible, visual or both to notify occupants of the building that the water heating system is leaking and has been shut down by the safety system.

Because the water heating system is shut down so quickly and completely with no water remaining to leak out, the water collecting sheet with the shallow basin should be sufficient to hold the small quantity of water that does leak out.

It is understood that the preceding description is given merely by way of illustration and not in limitation of the invention and that various modifications may be made thereto without departing from the spirit of the invention as claimed.

I claim:

1. An electrical safety system for shutting off all elements of a water heating device, wherein the electrical safety system comprises:

a water heating device having a tank for heating water, a means for heating the water, a water supply means feeding into the tank, a hot water distribution system leading from the tank, an overflow drain connected to the hot water distribution system and a power supply means feeding the means for heating the water;

a water collecting means comprising a water proof sheet of material having a shallow collecting basin on a portion of the sheet, wherein the water collecting means is placed under the tank of the water heating device for collecting any water which leaks from the water heating device;

a water sensing means comprising low power electrical contacts sensitive to water on the sheet within the shallow collecting basin for detecting any water which begins to accumulate within the collecting basin, wherein the electrical contacts are elevated above the sheet to a level which is below the height of the shallow collecting basin;

a normally open valve connected to the water supply means, which normally open valve closes to shut off the supply of water when the water sensing means detects water in the water collecting means;

a means for preventing backflow of hot fluid connected to the hot water distribution system;

a power shut-off means attached to the power supply means and electrically connected to and activated by the water sensing means;

an outflow pipe leading out of the water tank and, connected to the water sensing means, a means for activating an outflow of water out of the tank into the outflow pipe upon detecting water in the water collecting means;

an extension of the overflow drain into the water collecting means.

2. The invention of claim 1 wherein the water collecting means comprises a thin plastic sheet with a stiff pan built into the plastic, wherein the stiff pan forms a shallow water collecting basin.

3. The invention of claim 2 wherein an outer edge of the water collecting means is lifted and attached to an outer edge of the water heating device.

4. The invention of claim 1 wherein the water collecting means comprises a thin plastic sheet with a stiff pan built into the plastic, wherein the stiff pan forms a shallow water collecting basin, and wherein the thin plastic sheet is formed with three slots evenly spaced around an outer edge of the plastic sheet with each slot extending radially into the sheet to accommodate a leg of a water heating device within each slot, and wherein the slots form three flaps inbetween the slots, so that the water collecting means slides under an existing water heating device and the flaps of the plastic sheet may be attached to the water heating device.

5. The invention of claim 1 wherein the water sensing contacts are connected to a low voltage relay and the normally open valve to the water supply, the power shut-off means and the means for activating an outflow of water are all connected to the low voltage relay and all are activated upon closing of the low power electrical contacts by the presence of water in the water collecting means.

6. The invention of claim 5 wherein the means for preventing backflow comprises a normally open shut-off valve between the hot water distribution system and the water tank, wherein the normally open shut-off valve is connected to the low voltage relay and is activated upon closing of the low power electrical contacts by the presence of water in the water collecting means.

7. The invention of claim 5 wherein the water sensing contacts are connected to the low voltage relay and the normally open valve to the water supply, wherein the normally open valve is activated by the presence of water in the water collecting means to shut off the water supply.

8. The invention of claim 7 wherein the means for activating an outflow of water out of the tank into the outflow pipe comprises a pair of electrical contacts between the water supply control valve and a normally closed solenoid valve attached to a water tank drain so that when the water detector closes the water supply control valve a signal from the water supply control valve then opens the tank drain solenoid valve to drain all of the water out of the tank to empty the tank and prevent any further leakage from the tank, wherein an air vent automatically opens when the tank drain solenoid opens so that the water would flow freely out of the tank through the tank drain.

9. The invention of claim 7 wherein the means for activating an outflow of water out of the tank into the outflow pipe comprises a pair of electrical contacts between the water supply control valve and a normally closed water pump attached to a water tank drain so that when the water detector closes the water supply control valve a signal from the water supply control valve then activates the tank drain water pump to pump all of the water out of the tank to a distant drain to empty the tank and prevent any further leakage from the tank, wherein an air vent automatically opens when the tank drain solenoid opens so that the water would flow freely out of the tank through the tank drain.

10. The invention of claim 5 wherein the water heating device comprises an electric water heater having an electrical power supply and the power shut-off means comprises an electrical shut-off switch connected to the electrical power supply, wherein the power shut-off means is electrically connected to the low voltage relay and is activated upon closing of the low power electrical contacts by the presence of water in the water collecting means.

11. The invention of claim 5 wherein the water heating device comprises a gas water heater having a gas supply and the power shut-off means comprises a normally open shut-off valve connected to the gas supply, wherein the normally open shut-off valve is electrically connected to the low voltage relay and is activated upon closing of the low power electrical contacts by the presence of water in the water collecting means.

12. The invention of claim 5 wherein the water heating devices comprises an electric boiler having an electrical power supply and the power shut-off means comprises an electrical shut-off switch connected to the electrical power supply, wherein the power shut-off means is electrically connected to the low voltage relay and is activated upon closing of the low power electrical contacts by the presence of water in the water collecting means.

13. The invention of claim 5 wherein the water heating device comprises a gas boiler having a gas supply and the power shut-off means comprises a normally open shut-off valve connected to the gas supply, wherein the normally open shut-off valve is electrically connected to the low voltage relay and is activated upon closing of the low power electrical contacts by the presence of water in the water collecting means.

14. The invention of claim 5 wherein the water heating device comprises an oil powered boiler having an oil supply and the power shut-off means comprises a normally open shut-off valve connected to the oil supply, wherein the normally open shut-off valve is electrically connected to the low voltage relay and is activated upon closing of the low power electrical contacts by the presence of water in the water collecting means.

15. The invention of claim 14 further comprising an additional power shut-off means comprises an electrical shut-off switch connected to the electrical power supply for the oil powered boiler, wherein the additional power shut-off means is electrically connected to the low voltage relay and is activated upon closing of the low power electrical contacts by the presence of water in the water collecting means.

* * * * *